US011180355B1

(12) United States Patent
French

(10) Patent No.: US 11,180,355 B1
(45) Date of Patent: Nov. 23, 2021

(54) SCISSOR JACK COVER

(71) Applicant: Richard A. French, Fort Mohave, AZ (US)

(72) Inventor: Richard A. French, Fort Mohave, AZ (US)

( * ) Notice: Subject to any disclaimer, the term of this patent is extended or adjusted under 35 U.S.C. 154(b) by 0 days.

(21) Appl. No.: 17/114,599

(22) Filed: Dec. 8, 2020

(51) Int. Cl.
*B66F 13/00* (2006.01)
*A47F 3/00* (2006.01)

(52) U.S. Cl.
CPC ..... *B66F 13/00* (2013.01); *A47F 3/002* (2013.01)

(58) Field of Classification Search
CPC . B66F 13/00; A47F 3/002; B60P 7/02; B60D 1/605; B60N 2/162
See application file for complete search history.

(56) References Cited

U.S. PATENT DOCUMENTS

| | | | | |
|---|---|---|---|---|
| 3,202,193 | A | 8/1965 | Ware | |
| 5,037,122 | A | 8/1991 | Beckerer et al. | |
| 6,065,268 | A | 5/2000 | Gump | |
| 9,475,371 | B2 * | 10/2016 | LaBiche | B60J 7/1204 |
| 10,569,607 | B1 | 2/2020 | Alalouf | |

OTHER PUBLICATIONS

Universal RV Electric Tongue Jack Cover By RV Cover Supply. Product Listing [online], © 2020, RV Cover Supply [retrieved on Jun. 15, 2020], Retrieved from the Internet: <URL: https://www.etrailer.com/Camper-Jacks/etrailer/EJ-3520-BBX.html>.

Ultra-Fab Protective Cover for Electric A-Frame Jacks—Vinyl—10-1/2"×13-3/4". Product Listing [online], copyright etrailer.com [retrieved on Jun. 15, 2020]. Retrieved from the Internet: <URL: https://www.etrailer.com/Accessories-and-Parts/Ultra-Fab-Products/UF38-944020.html?feed=npn&gclid=Cj0KCQjwuJz3BRDTARIsAMg-HxVi_reGQcsJzcytC788PLWik1GzKwlYBGFTsp7LZd4n_BHIOzq1sx4aAgWEEALw_wcB>.

Jack Covers for Hi-Lift Jacks. Product Listing [online], © 2020 STEP 22 Gear [retrieved on Jun. 15, 2020], Retrieved from the Internet: <URL: https://step22gear.com/products/hi-lift-jack-covers>.

JHi-Lift Neoprene Jack Cover, Product Listing [online]. Copyright © 2020 Sportsman's Warehouse [retrieved on Jun. 15, 2020], Retrieved from the Internet: <URL: https://www.jegs.eom/i/Hi-Lift/511/RGJC/10002/-1>.

* cited by examiner

*Primary Examiner* — Mahdi H Nejad
(74) *Attorney, Agent, or Firm* — Cramer Patent & Design PLLC; Aaron R. Cramer

(57) ABSTRACT

The scissor jack cover may be a protective cover for an individual scissor jack. The individual scissor jack may be coupled to the underside of a vehicle. While residing inside of a cavity within the scissor jack cover, the individual scissor jack may be protected from water, road salt, dirt, and other contaminants which may make the individual scissor jack difficult to operate. The vehicle may employ a plurality of scissor jacks to level and stabilize the vehicle when the vehicle is stationary. Multiple instances of the scissor jack cover may be deployed to protect each of the plurality of scissor jacks dispersed beneath the vehicle. As a non-limiting example, the vehicle may be a toy hauler trailer, a recreational vehicle, a travel trailer, a motor home, or other conveyance.

18 Claims, 7 Drawing Sheets

FIG. 11A
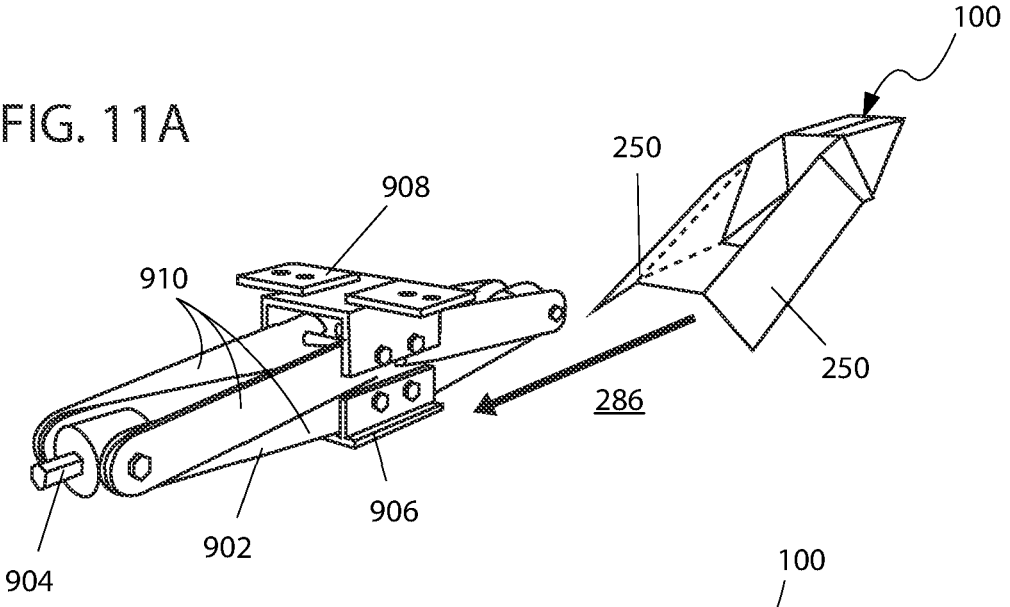
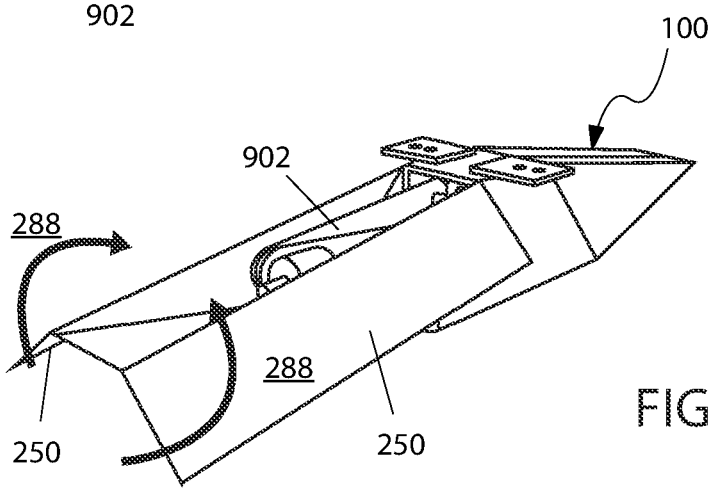
FIG. 11B
FIG. 11C
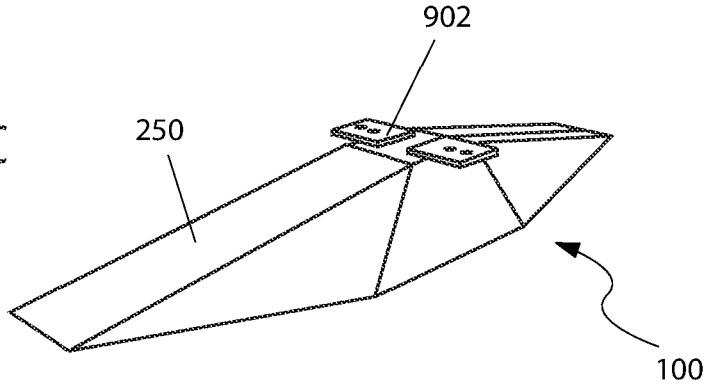

SCISSOR JACK COVER

RELATED APPLICATIONS

Not applicable.

FIELD OF THE INVENTION

The present invention relates generally to a scissor jack cover.

BACKGROUND OF THE INVENTION

Scissor jacks are used all over the world to enable an individual to lift a heavy object. In most instances, these types of jacks are used to facilitate changing a tire; however, in the trucking industry, such jacks are often used to level off a toy hauler or trailer.

Because these jacks are mounted beneath the trailer, over time exposure to the elements causes dirt, grime, and rust to impair if not render useless a given scissor jack. As such a need exists for a device which protects the scissor jack from the elements in a manner which is cost effective and efficient. The scissor jack cover fulfills this need.

SUMMARY OF THE INVENTION

To achieve the above and other objectives, the present invention provides for a scissor jack cover which has a bottom panel which is configured on a base of an individual scissor jack, a rear under panel configured on a rear of the scissor jack cover, a front under panel which is coupled to a front of the bottom panel and extends away from the bottom panel in a forward direction that is inclined upwards, a rear top panel which is coupled to the rear under panel and extends away from a rear of the rear under panel in an inclined forward direction, a first door panel which has a plurality of first overlapping flaps at the top front of the scissor jack cover, a second door panel which has a plurality of second overlapping flaps at the top front of the scissor jack cover, a left side panel which is configured on the left side of the individual scissor jack and a right-side panel which is configured on the right side of the individual scissor jack. The left side panel while the right-side panel define a center trapezoid portion, a front triangle portion, and a rear triangle portion.

The bottom panel may be configured on a bottom of the base of the individual scissor jack while the rear under panel may be configured on a bottom rear of the scissor jack cover. The front under panel may be configured on the bottom front of the scissor jack cover. The front under panel may be configured on the underside of the lifting arms at a front of the individual scissor jack. The rear top panel may be configured on a top rear of the scissor jack cover. The rear top panel may be configured on a top side of the lifting arms at the rear of the individual scissor jack. The first door panel and the second door panel may overlap to cover the lifting arms at the front of the individual scissor jack and to hold the scissor jack cover in place on the individual scissor jack.

The first door panel and the second door panel may be coupled to the left side panel and the right-side panel. The first door panel and the second door panel may be coupled to the right-side panel and the left side panel. The left side panel may be coupled to the left side of the bottom panel, the rear under panel, the front under panel, and the rear top panel. The left side panel and the right-side panel may be both separated into the center trapezoid portions, the front triangle portions, and the rear triangle portions. The center trapezoid portion, the front triangle portion, and the rear triangle portion on the left side are coupled to form the left side panel. The right-side panel may be coupled to the right side of the bottom panel, the rear under panel, the front under panel, and the rear top panel.

The center trapezoid portion, the front triangle portion, and the rear triangle portion on the right side may be coupled to form the right-side panel. The scissor jack cover may be a protective cover for the individual scissor jack. The individual scissor jack may be coupled to an underside of a vehicle. The individual scissor jack may be placed in a collapsed configuration and is covered by the scissor jack cover while the vehicle is in motion. The individual scissor jack may be protected from water, road salt, dirt, and other contaminants while residing inside of a cavity within the scissor jack cover. The scissor jack cover may be made of a waterproof material selected from the group consisting of waterproof canvas, waterproof vinyl, waterproof coated polyester, waterproof polyethylene, waterproof ripstop nylon, or any combinations thereof.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

FIG. 11A is an in-use view of a scissor jack cover 100, according to an embodiment of the present invention, illustrating alignment of the scissor jack cover 100 and an individual scissor jack 902;

FIG. 11B is an in-use view of a scissor jack cover 100, according to an embodiment of the present invention, illustrating the individual scissor jack 902 in place within the scissor jack cover 100; and, FIG. 11C is an in-use view of a scissor jack cover 100, according to an embodiment of the present invention, illustrating the door flaps 250 of the scissor jack cover 100 closed around the individual scissor jack 902.

DESCRIPTIVE KEY

Figure 1:
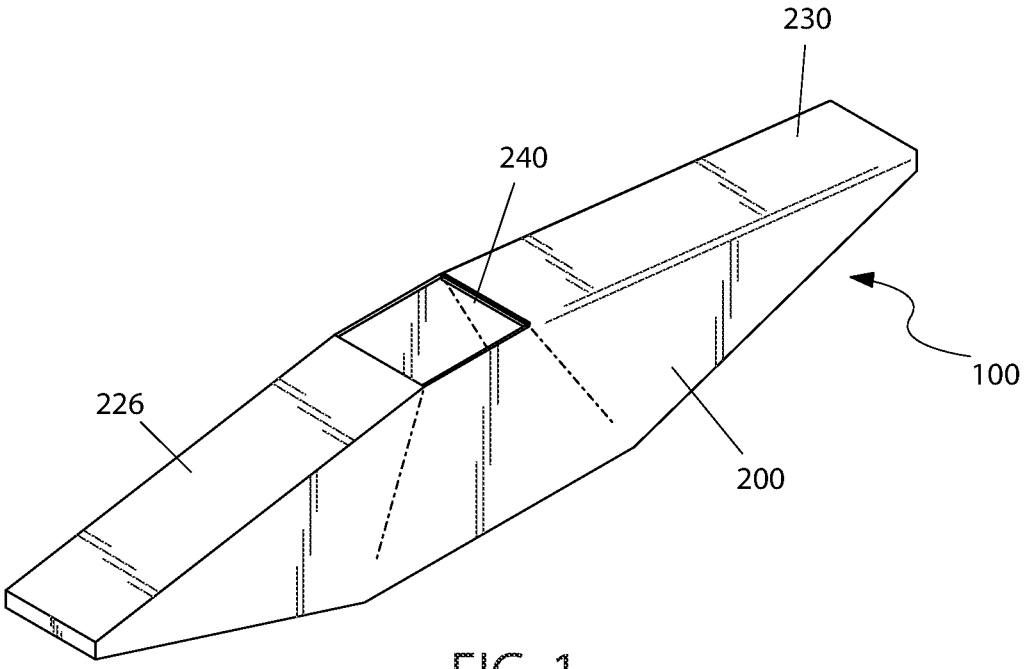
FIG. 1 is an isometric rear view of a scissor jack cover 100, according to an embodiment of the present invention.

100 scissor jack cover
200 left side panel

202 right side panel
212 center trapezoid portion
214 front triangle portion
216 rear triangle portion
220 bottom panel
222 rear underpanel
224 front underpanel
226 rear top panel
228 plurality of tabs
230 first door panel
232 first fastener
234 second door panel
236 second fastener
240 jack aperture
242 cavity
250 door flap
252 first rear top panel half
254 second rear top panel half
260 single sheet of material
280 front wedge
282 rear wedge
286 slide
288 folded
902 individual scissor jack
904 threaded rod
906 base
908 top plate
910 plurality of lifting arms

DESCRIPTION OF THE INVENTION

The present invention is directed to a scissor jack cover (herein described as the "invention") 100. The invention 100 may be a protective cover for an individual scissor jack 902. The individual scissor jack 902 may be coupled to the underside of a vehicle. The individual scissor jack 902 may be placed in a collapsed configuration and may be covered by the invention 100 while the vehicle is in motion. The individual scissor jack 902 may be protected from water, road salt, dirt, and other contaminants while residing inside of a cavity 242 within the invention 100. Contaminants may promote oxidation of the individual scissor jack 902 and may mix with lubricants used on the individual scissor jack 902, both of which may make the individual scissor jack 902 difficult to operate. The vehicle may employ a plurality of scissor jacks to level and stabilize the vehicle when the vehicle is stationary. As a non-limiting example, the vehicle may be a toy hauler trailer, a recreational vehicle, a travel trailer, a motor home, or other conveyance. Multiple instances of the invention 100 may be deployed to protect each of the plurality of scissor jacks dispersed beneath the vehicle.

The individual scissor jack 902 may be placed in an expanded configuration by cranking a threaded rod 904 in a first rotational direction using a crank handle. In the expanded configuration, a plurality of lifting arms 910 may pivot towards a vertical orientation to increase the separation between a base 906 of the individual scissor jack 902 and one (1) or more top plates 908 that couple the individual scissor jack 902 to the vehicle, thus pressing the base 906 against the ground. The individual scissor jack 902 in the expanded configuration may lift the vehicle to level the vehicle, may stabilize the vehicle during stationary use of the vehicle, or both.

The individual scissor jack 902 may be placed in the collapsed configuration by cranking the threaded rod 904 in a second rotational direction which is opposite the first rotational direction. In the collapsed configuration, the plurality of lifting arms 910 may pivot towards a horizontal orientation to decrease the separation between the base 906 and the one (1) or more top plates 908, thus raising the base 906 from the ground. The individual scissor jack 902 in the collapsed configuration may retain the base 906 above the surface of the road while the vehicle is moving.

The invention 100 may be placed onto the individual scissor jack 902 in order to protect the individual scissor jack 902 during travel when the individual scissor jack 902 is in the collapsed configuration. The invention 100 may be removed from the individual scissor jack 902 in order to place the individual scissor jack 902 into the expanded configuration.

Figure 2:
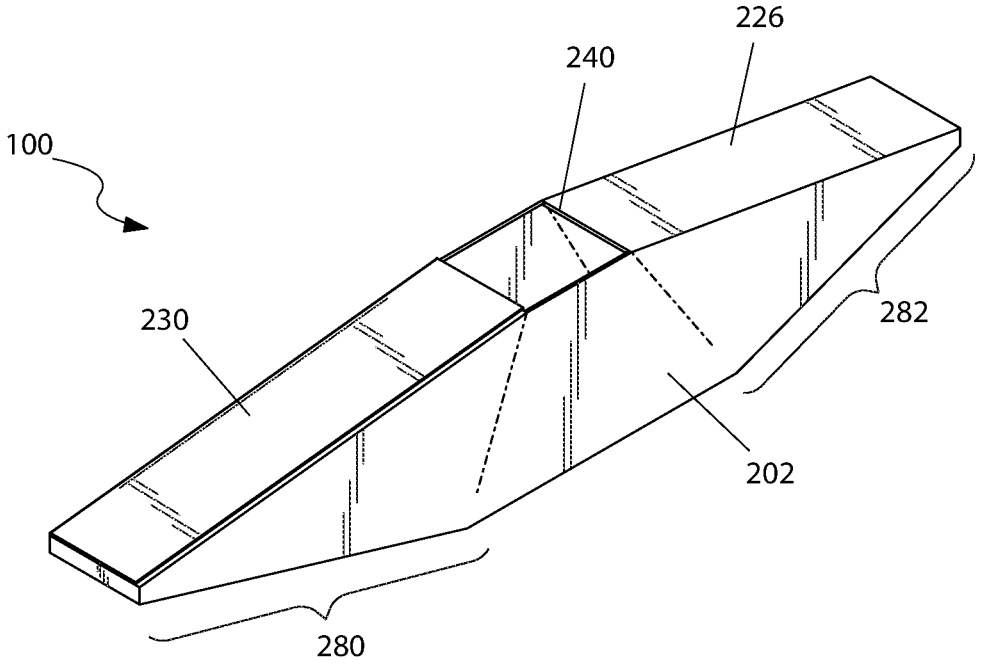
FIG. 2 is an isometric front view of a scissor jack cover 100, according to an embodiment of the present invention.

FIG. 2 is an isometric front view of a scissor jack cover 100, according to an embodiment of the present invention. The protective cover may conform to the shape of the individual scissor jack 902 when the individual scissor jack 902 is in the collapsed configuration. Specifically, the protective cover may provide a bottom panel 220 that fits against the base 906 of the individual scissor jack 902, a front wedge 280 and a rear wedge 282 that envelop the plurality of lifting arms 910, and a jack aperture 240 at the top to permit the one (1) or more top plates 908 of the individual scissor jack 902 to remain coupled to the vehicle while the individual scissor jack 902 is enclosed within the protective cover. Door flaps 250 may open to permit the invention 100 to slide onto and off of the individual scissor jack 902 and may close to cover the plurality of lifting arms 910 of the individual scissor jack 902.

Figure 7:
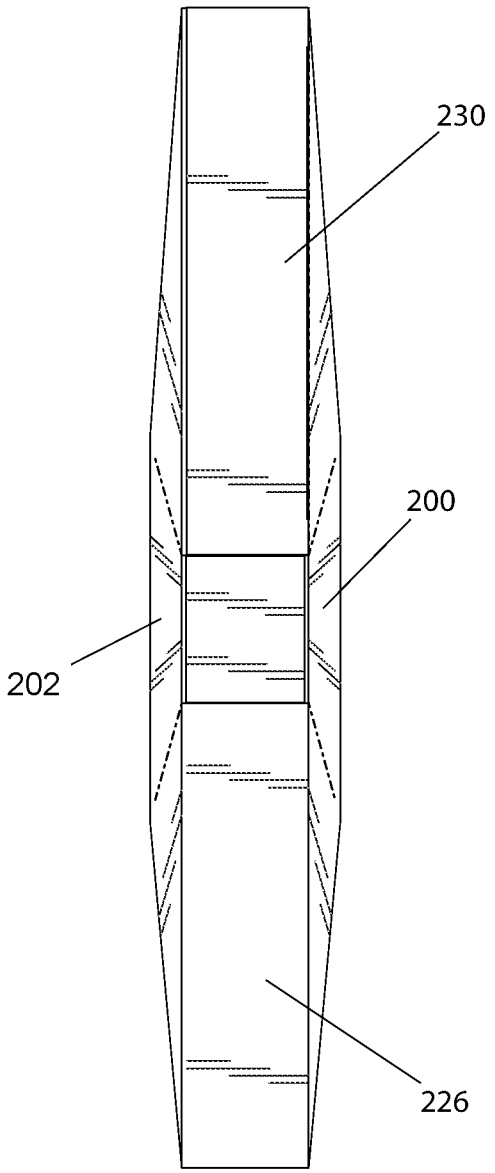
FIG. 7 is a top view of a scissor jack cover 100, according to an embodiment of the present invention.
Figure 8:
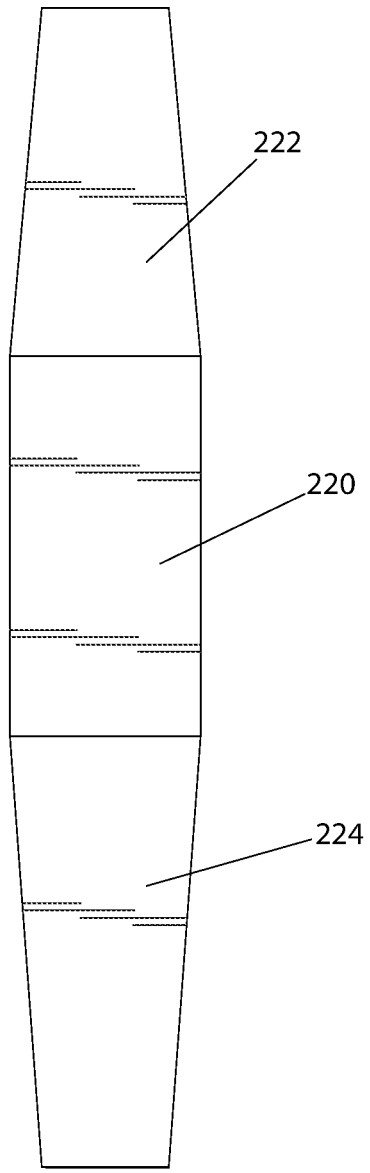
FIG. 8 is a bottom view of a scissor jack cover 100, according to an embodiment of the present invention.
Figure 9:
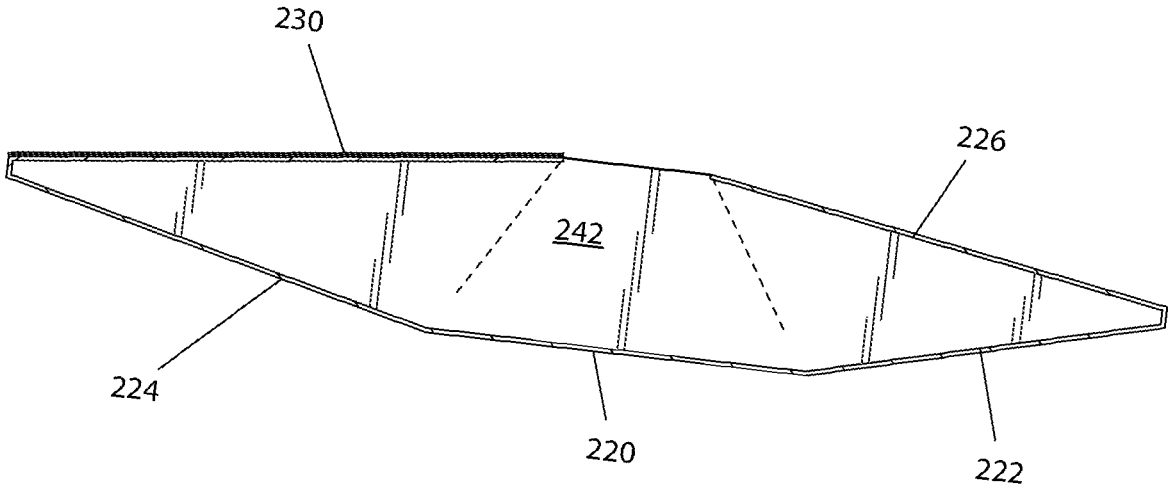
FIG. 9 is a cross-sectional view of a scissor jack cover 100 across I-I as shown in FIG. 1, according to an embodiment of the present invention.

FIG. 1 is an isometric rear view of a scissor jack cover 100, according to an embodiment of the present invention. FIG. 7 is a top view of a scissor jack cover 100, according to an embodiment of the present invention. FIG. 8 is a bottom view of a scissor jack cover 100, according to an embodiment of the present invention. In some embodiments, the invention 100 may comprise the bottom panel 220, a rear underpanel 222, a front underpanel 224, a rear top panel 226, a first door panel 230, a second door panel 234, a left side panel 200, and a right side panel 202 which may be collectively referred to as panels. The bottom panel 220 may be a rectangular panel comprising the lowest level of the protective cover. The bottom panel 220 may cover the bottom of the base 906 of the individual scissor jack 902.

Figure 3:
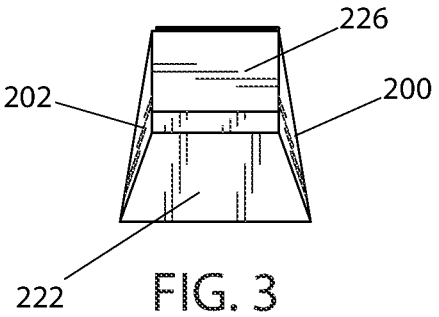
FIG. 3 is a rear view of a scissor jack cover 100, according to an embodiment of the present invention.

FIG. 3 is a rear view of a scissor jack cover 100, according to an embodiment of the present invention. The rear underpanel 222 may be located on the bottom rear of the invention 100. The rear underpanel 222 may be coupled to the rear of the bottom panel 220 and may extend away from the bottom panel 220 in a rearward direction that is inclined upwards. The rear underpanel 222 may cover the underside of the plurality of lifting arms 910 at the rear of the individual scissor jack 902.

Figure 4:
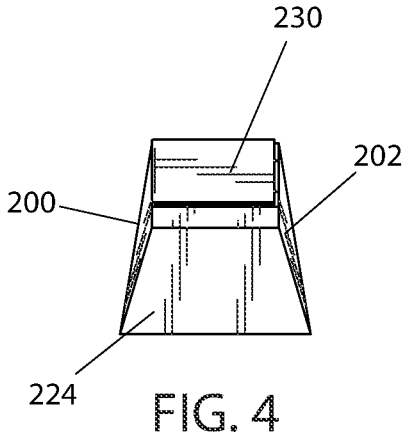
FIG. 4 is a front view of a scissor jack cover 100, according to an embodiment of the present invention.

FIG. 4 is a front view of a scissor jack cover 100, according to an embodiment of the present invention. The front underpanel 224 may be located on the bottom front of the invention 100. The front underpanel 224 may be coupled to the front of the bottom panel 220 and may extend away from the bottom panel 220 in a forward direction that is inclined upwards. The front underpanel 224 may cover the underside of the plurality of lifting arms 910 at the front of the individual scissor jack 902.

FIG. 7 is a top view of a scissor jack cover 100, according to an embodiment of the present invention. The rear top panel 226 may be located on the top rear of the invention 100. The rear top panel 226 may be coupled to the rear underpanel 222 and may extend away from the rear of the rear underpanel 222 in an inclined forward direction. The rear top panel 226 may cover the top side of the plurality of lifting arms 910 at the rear of the individual scissor jack 902.

The first door panel 230 and the second door panel 234 may comprise overlapping flaps at the top front of the invention 100. The first door panel 230 and the second door panel 234 may be coupled to the left side panel 200 and the right side panel 202, or vice versa. The first door panel 230 and the second door panel 234 may overlap to cover the plurality of lifting arms 910 at the front of the individual scissor jack 902 and to hold the invention 100 in place on the individual scissor jack 902. When overlapping, a first fastener 232 on the first door panel 230 may engage a second fastener 236 on the second door panel 234 to hold the door flaps 250 closed. As a non-limiting example, the first fastener 232 and the second fastener 236 may be halves of a hook-and-loop-type fastener. The first door panel 230 and the second door panel 234 may be decoupled from each other and opened to expose the cavity 242 within the invention 100 for inserting or removing the individual scissor jack 902.

The left side panel 200 and the right side panel 202 may cover the left and right side of the individual scissor jack 902, respectively. The left side panel 200 may be coupled to the left side of the bottom panel 220, the rear underpanel 222, the front underpanel 224, and the rear top panel 226. The right side panel 202 may be coupled to the right side of the bottom panel 220, the rear underpanel 222, the front underpanel 224, and the rear top panel 226.

Where edges of two (2) of the panels meet, the panels may be coupled. As non-limiting examples, the panels may be coupled using stitched seams such as plain seams or lapped seams, adhesives, rivets, other fasteners, or combinations thereof. The invention 100 may comprise a plurality of tabs 228 to aid in the coupling of the panels. An individual tab may be an extension of an individual panel. As non-limiting examples, the individual tabs may be coupled to an adjacent panel or to another individual tab. The plurality of tabs 228 may also be operable to reinforce the material comprising the panels. As a non-limiting example, the individual tab may be folded back one hundred eighty degrees (180°) onto the individual panel that the individual tab is an extension of and may be coupled to the individual panel, thus doubling the thickness of the material at the edge of the individual panel. As a non-limiting example, the jack aperture 240 may be reinforced by the plurality of tabs 228 on the panels surrounding the jack aperture 240.

The base 906 may be larger than the jack aperture 240, therefore the sides of the invention 100 may slope inwards towards the top. In addition, the plurality of lifting arms 910 may be narrower than either the base 906 or the jack aperture 240, therefore the front wedge 280 and the rear wedge 282 may be narrower from side to side at the distal ends of the front wedge 280 and the rear wedge 282 than at the proximal ends of the front wedge 280 and the rear wedge 282. Because of this, an individual side panel selected from the left side panel 200 and the right side panel 202 may define a center trapezoid portion 212, a front triangle portion 214, and a rear triangle portion 216. The center trapezoid portion 212 may extend from the base 906 to the jack aperture 240 and may slope inwards towards the top of the invention 100. The front triangle portion 214 may cover one (1) side of the front lifting arms and may be non-coplanar with the center trapezoid portion 212. The rear triangle portion 216 may cover one (1) side of the rear lifting arms and may be non-coplanar with the center trapezoid portion 212 and non-coplanar with the front triangle portion 214.

Figure 5:
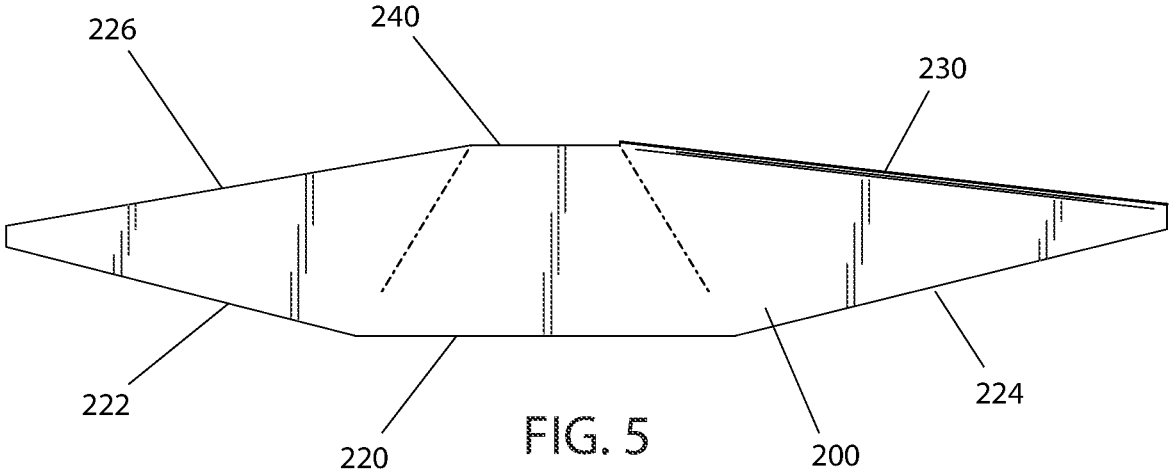
FIG. 5 is a left side view of a scissor jack cover 100, according to an embodiment of the present invention.
Figure 6:
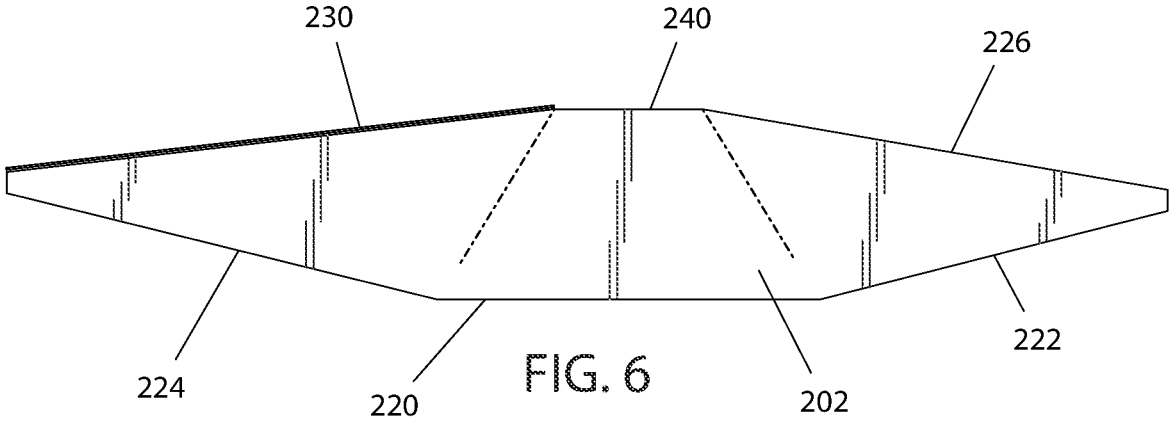
FIG. 6 is a right side view of a scissor jack cover 100, according to an embodiment of the present invention.

FIG. 5 is a left side view of a scissor jack cover 100, according to an embodiment of the present invention. FIG. 6 is a right side view of a scissor jack cover 100, according to an embodiment of the present invention. In some embodiments, the invention 100 may be formed from a single sheet of material 260 that may be cut or stamped according to a pattern. The pattern may define the left side panel 200, the right side panel 202, the bottom panel 220, the rear underpanel 222, the front underpanel 224, the first door panel 230, the second door panel 234, the rear top panel 226. The pattern may be optimized to reduce waste. As a non-limiting example, the pattern may be substantially symmetrical in both lateral and longitudinal directions.

As non-limiting examples, the panels of the invention 100 may be made from waterproof canvas, vinyl, coated polyester, polyethylene, ripstop nylon, or combinations thereof.

Figure 10:
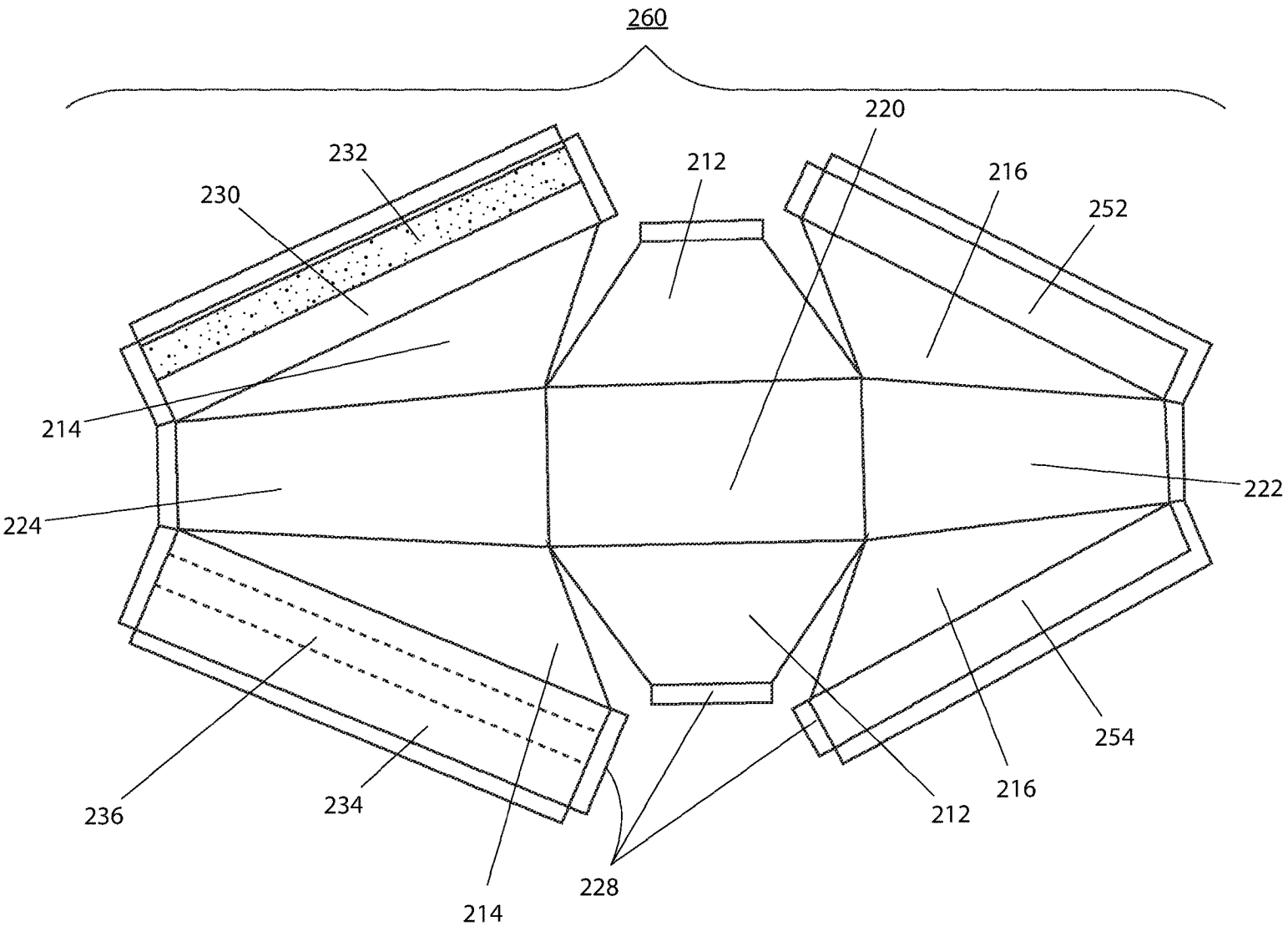
FIG. 10 is a detail view of a scissor jack cover 100, according to an embodiment of the present invention, illustrating the scissor jack cover cut from a single piece of material and prior to final assembly.

There may be many ways that the invention 100 can be cut from the single sheet of material 260 and FIG. 10 illustrates one such embodiment. Note that in FIG. 10, the left side panel 200 and the right side panel 202 are both separated into the center trapezoid portions 212, the front triangle portions 214, and the rear triangle portions 216. The center trapezoid portion 212, the front triangle portion 214, and the rear triangle portion 216 on the left side may be coupled to form the left side panel 200. The center trapezoid portion 212, the front triangle portion 214, and the rear triangle portion 216 on the right side may be coupled to form the right side panel 202. Also note in FIG. 10 that the rear top panel 226 may be split longitudinally into a first rear top panel half 252 and a second rear top panel half 254 which may be coupled to each other to form the rear top panel 226.

FIGS. 11A, 11B and 11C illustrate a sequence of the invention 100 being installed on the individual scissor jack 902. FIG. 11A illustrates the invention 100, with the door flaps 250 open, aligned behind the individual scissor jack 902 in the collapsed configuration. The invention 100 is ready to slide 286 onto the individual scissor jack 902. FIG. 11B illustrates the invention 100 in place on the individual scissor jack 902. The door flaps 250 are ready to be folded 288 closed to protect the individual scissor jack 902 and to retain the invention 100 in place on the individual scissor jack 902. FIG. 11C illustrates the individual scissor jack 902 protected by the invention 100 and ready to travel as the vehicle is driven. Upon arriving at a destination, this sequence may be reversed to expose the individual scissor jack 902 for deployment.

In use, the individual scissor jack 902 may be cranked up to the collapsed configuration. The door flaps 250 of the invention 100 may be opened and the invention 100 may be slipped onto the individual scissor jack 902 by passing the invention 100 over the individual scissor jack 902 from the rear such that the individual scissor jack 902 slides into the cavity 242 within the invention 100. The door flaps 250 may be closed to hold the invention 100 on the individual scissor jack 902. The vehicle may then be driven to another location. To deploy the individual scissor jack 902 with the vehicle stationary, the door flaps 250 may be opened and the invention 100 may be pulled off of the individual scissor jack 902 from the rear.

The exact specifications, materials used, and method of use of the invention 100 may vary upon manufacturing. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A scissor jack cover, comprising:

a bottom panel configured on a base of an individual scissor jack;

a rear under panel disposed on a rear of the individual scissor jack cover;

a front under panel coupled to a front of the bottom panel, the front under panel extends away from the bottom panel in a forward direction that is inclined upwards;

a rear top panel coupled to the rear under panel, the rear top panel extends away from a rear of the rear under panel in an inclined forward direction;

a first door panel having a plurality of first overlapping flaps at the top front of the individual scissor jack cover;

a second door panel having a plurality of second overlapping flaps at the top front of the individual scissor jack cover;

a left side panel configured on the left side of the individual scissor jack; and a right-side panel configured on the right side of the individual scissor jack, the left side panel and the right-side panel define a center trapezoid portion, a front triangle portion, and a rear triangle portion;

wherein the front under panel is configured on an underside of a plurality of lifting arms at a front of the individual scissor jack: and wherein the first door panel and the second door panel are adapted to overlap to cover the plurality of lifting arms at the front of the individual scissor jack and to hold the individual scissor jack cover in place on the individual scissor jack.

2. The scissor jack cover, according to claim 1, wherein the bottom panel is disposed on a bottom of the base of the individual scissor jack.

3. The scissor jack cover, according to claim 1, wherein the rear under panel is disposed on a bottom rear of the scissor jack cover.

4. The scissor jack cover, according to claim 1, wherein the front under panel is disposed on a bottom front of the scissor jack cover.

5. The scissor jack cover, according to claim 1, wherein the rear top panel is disposed on a top rear of the scissor jack cover.

6. The scissor jack cover, according to claim 1, wherein the rear top panel is configured on a top side of the lifting arms at the rear of the individual scissor jack.

7. The scissor jack cover, according to claim 1, wherein the first door panel and the second door panel are coupled to the left side panel and the right-side panel.

8. The scissor jack cover, according to claim 1, wherein the first door panel and the second door panel are coupled to the right-side panel and the left side panel.

9. The scissor jack cover, according to claim 1, wherein the left side panel is coupled to the left side of the bottom panel, the rear under panel, the front under panel, and the rear top panel.

10. The scissor jack cover, according to claim 1, wherein the left side panel and the rightside panel are both separated into the center trapezoid portions, the front triangle portions, and the rear triangle portions.

11. The scissor jack cover, according to claim 1, wherein the center trapezoid portion, the front triangle portion, and the rear triangle portion on the left side are coupled to form the left side panel.

12. The scissor jack cover, according to claim 1, wherein the right-side panel is coupled to the right side of the bottom panel, the rear under panel, the front under panel, and the rear top panel.

13. The scissor jack cover, according to claim 1, wherein the center trapezoid portion, the front triangle portion, and the rear triangle portion on the right side are coupled to form the right-side panel.

14. The scissor jack cover, according to claim 1, wherein the scissor jack cover is a protective cover for the individual scissor jack.

15. The scissor jack cover, according to claim 1, wherein the individual scissor jack is adapted to be coupled to an underside of a vehicle.

16. The scissor jack cover, according to claim 15, wherein the individual scissor jack is placed in a collapsed configuration and is adapted to be covered by the scissor jack cover while the vehicle is in motion.

17. The scissor jack cover, according to claim 1, wherein the individual scissor jack is protected from water, road salt, dirt, and other contaminants while residing inside of a cavity within the scissor jack cover.

18. The scissor jack cover, according to claim 1, wherein the scissor jack cover is made of a waterproof material selected from the group consisting of waterproof canvas, waterproof vinyl, waterproof coated polyester, waterproof polyethylene, waterproof ripstop nylon, or any combinations thereof.

* * * * *